US011104469B1

(12) United States Patent
Muething et al.

(10) Patent No.: US 11,104,469 B1
(45) Date of Patent: Aug. 31, 2021

(54) SYSTEM AND METHOD FOR PLACING LABELS ON MOVING OBJECTS

(71) Applicant: Amazon Technologies, Inc., Seattle, WA (US)

(72) Inventors: Daniel Muething, Seattle, WA (US); Richa Rastogi, Brooklyn, NY (US); Keith C. Tate, Middletown, DE (US); Anand Harshad Doshi, Bellevue, WA (US); John Kevin Robinson, Issaquah, WA (US); Mahmoud Abugharbieh, Everett, WA (US)

(73) Assignee: Amazon Technologies, Inc., Seattle, WA (US)

( * ) Notice: Subject to any disclaimer, the term of this patent is extended or adjusted under 35 U.S.C. 154(b) by 88 days.

(21) Appl. No.: 16/703,402

(22) Filed: Dec. 4, 2019

(51) Int. Cl.

| | |
|---|---|
| ***B65C 9/40*** | (2006.01) |
| ***B65C 9/02*** | (2006.01) |
| ***B65C 9/36*** | (2006.01) |
| ***B65C 1/02*** | (2006.01) |

(52) U.S. Cl.
CPC ..... *B65C 9/40* (2013.01); *B65C 1/021* (2013.01); *B65C 9/02* (2013.01); *B65C 9/36* (2013.01); *B65C 2009/401* (2013.01)

(58) Field of Classification Search
CPC .. B65C 1/021; B65C 9/02; B65C 9/32; B65C 9/36; B65C 9/40; B65C 9/42; B65C 2009/401
See application file for complete search history.

(56) References Cited

U.S. PATENT DOCUMENTS 9,802,728 B1 * 10/2017 Rodgers ..... B65C 1/021
2003/0034111 A1 * 2/2003 Oldenburg ..... B65C 9/42 156/64

* cited by examiner

*Primary Examiner* — George R Koch
(74) *Attorney, Agent, or Firm* — Thomas | Horstemeyer, LLP

(57) ABSTRACT

Disclosed are various embodiments for systems and methods for calibrating a label applicator for improved accuracy and/or precision on moving objects. In one example, a system may be configured to receive a height of a package on a conveyor path prior to the package reaching a label applicator. The system can be configured to determine a predicted tamp time for the package based on the height. The predicted tamp time can represent an estimated period of time for a tamp head to apply a label on the package. The system also can instruct a controller operating a label applicator to activate the tamp head for the package based on the predicted tamp time. The system can receive an actual tamp time from the controller after the label has been applied to the package and update the modeling coefficient based on a tamp time error.

20 Claims, 7 Drawing Sheets

SYSTEM AND METHOD FOR PLACING LABELS ON MOVING OBJECTS

BACKGROUND

In a conveyor system, a label applicator can apply labels to packages being transported on a conveyor belt. The label applicator can apply labels when the package is stationary or moving along the conveyor belt. When labels are applied on moving packages, the label applicator can increase its throughput. However, the placement accuracy of the label applicator may decrease. Additionally, the label applicator may need to be calibrated in order to maintain accurate label placement on packages because of a variety of other factors, such as fluctuations in environmental conditions and wear of components used by the label applicator.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
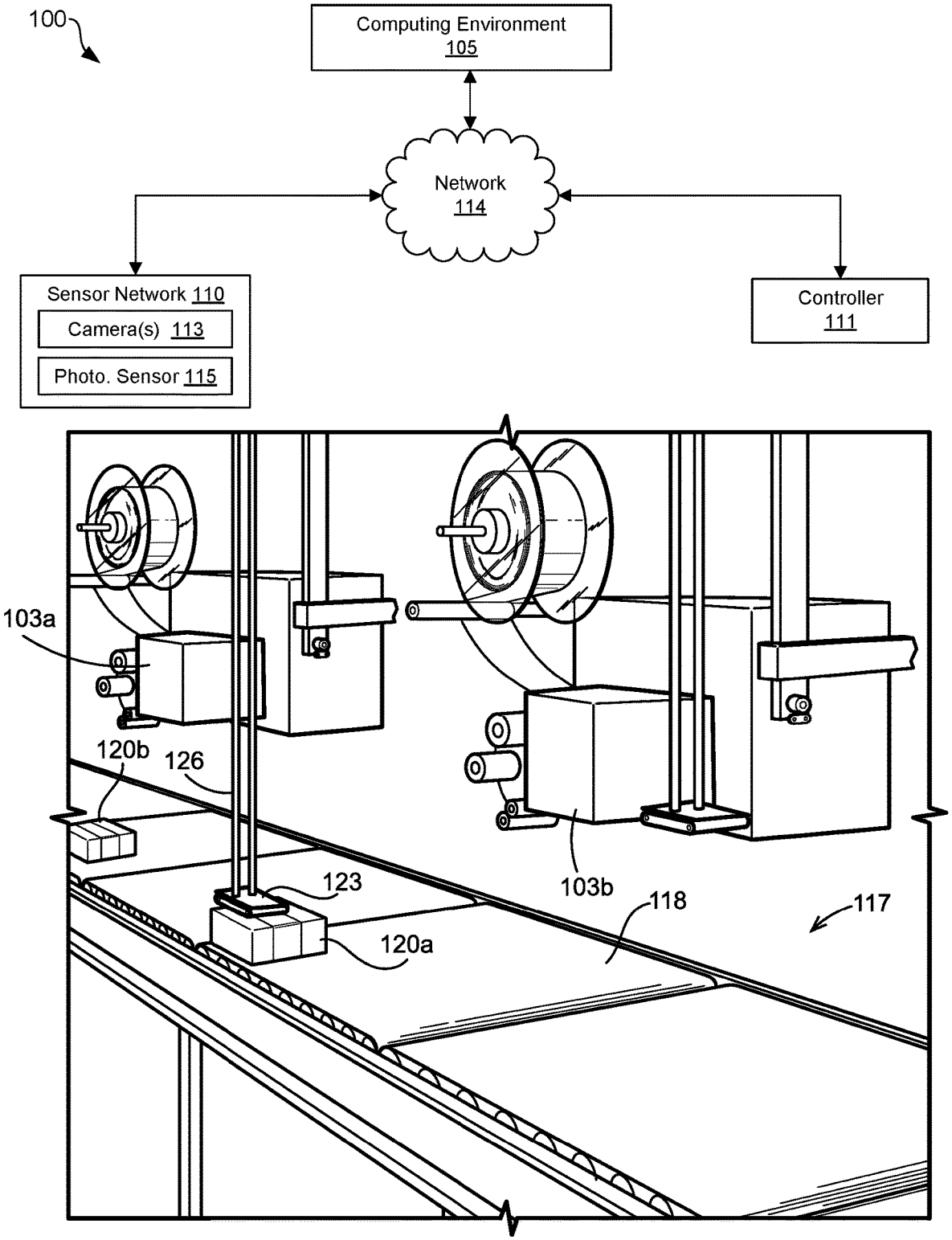
FIG. 1 is a drawing of an example scenario of multiple label applicators according to various embodiments of the present disclosure.

The present disclosure relates to systems and methods for calibrating a label applicator for placement accuracy and/or precision on moving objects. In a fulfillment center, packages are transported on a conveyor system for processing at different stages. For example, a portion of the conveyor system may involve applying shipping labels on packages traveling on the conveyor belt. A label applicator can be suspended above the conveyor belt in order to apply labels to packages on the conveyor belt. In some scenarios, the package can be moved along the conveyor belt to a targeted location for a label to be applied. The label applicator can apply labels on packages that are stationary or moving on the conveyor belt. When labels are applied on moving packages, the label applicator can increase its throughput, but applying labels with accuracy can be challenging.

Additionally, the label applicator may place labels with poor accuracy with respect to a targeted location on a package for a variety of other reasons. For example, an intended label location may be one inch from a first edge and one inch from a second edge of a first package. Instead, the label may be placed in such a way in which a portion of the label hangs off the edge of the package because of different environmental factors, such as wear on the label applicator components. In other cases, the poor placement can result from a variability of target label locations. For instance, a second package may have a target label placement that is six inches from the first edge and two inches form the second edge of a packages.

In other cases, the label placement may be inconsistent because the label applicator may be calibrated for short packages, but may be mis-calibrated for tall packages. The package height is relevant because the label applicator has a different travel distance for lowering a tamp head to apply the label. Over time, the timing for the mechanical components used for lowering the tamp head may need to change in order to apply labels on moving packages. With these factors in mind, the calibration of label applicators across multiple package heights and multiple placement targets can be difficult and can require calibrating over several iterations.

Additionally, many label applicators do not have a feedback mechanism for identifying when its components need to be calibrated, other than an operator visually inspecting packages with inaccurate placement. If an operator fails to identify an uncalibrated label applicator, the improper placement of labels can cause errors downstream in later processing stages along the conveyor system.

The various embodiments of the present disclosure relate to systems and methods for autonomously calibrating a label applicator in order to improve accuracy and/or precision of a label placement on packages on a conveyor system. The embodiments involve one or more closed-loop systems for providing feedback on the label placement on a package. The feedback received from the closed-loop systems can be used to evaluate the label placement performance for the label applicator and calibrate the label applicator when needed. Various aspects of the closed-loop systems can be useful for correcting the label applicator used for placing labels on stationary or moving packages on a conveyor belt. In addition, the label applicator can employ unique calibration data for each package on a conveyor system. The unique calibration data can help optimize label placement to account for different heights of each package. Additionally, the label applicator can achieve a higher throughput as a result of improved calibration methods described herein, particularly when labels are applied on moving packages on the conveyor belt. In the following discussion, a general description of the system and its components is provided, followed by a discussion of the operation of the same.

Beginning with FIG. 1, shown is a first example scenario of a networked label applicator environment 100. The networked label applicator environment 100 comprises a first label applicator 103*a*, a second label applicator 103*b* (collectively the "label applicators 103"), a computing environment 105, a sensor network 110, and a controller 111, which are in data communication via a network 114. The sensor network 110 can include one or more cameras 113 and a photoelectric sensor 115, among other types of sensors. The label applicator environment 100 also includes a conveyor system 117. The conveyor system 117 includes a conveyor belt 118 for moving a first package 120*a* and a second package 120*b*, among others, according to the example shown. The conveyor belt 118 can also be considered as a conveyor path.

The label applicators 103 can apply labels on the first package 120*a* and the second package 120*b*. The label applicator 103*a* includes a tamp head 123 attached to an actuator 126, and the label applicator 103*b* includes a similar tamp head 123. The tamp head 123 can refer to a mechanical component that is fed a label, and the tamp head 123 applies the label to a package. The label applicators 103 are suspended above the conveyor system 117. As a result, the actuator 126 can be used to extend the tamp head 123 downward in order to apply a label to the package 120*a*, for example, as shown in FIG. 1. The label applicators 103 can be used to apply labels on packages 120 that are stationary or moving on the conveyor belt 118. In some scenarios, a label applicator 103 applies labels on moving packages 120 in order to improve throughput.

The computing environment 105 may comprise, for example, a server computer or any other system providing computing capability. In some embodiments, the computing environment 105 can be used to determine calibration data for the controller 111, and the controller 111 can use the calibration data for operating the label applicators 103, particularly the tamp head 123.

The controller 111 can be a computing device that controls or operates one or more label applicators 103, such as a programmable logic controller or similar device. In some examples, the controller 111 can use calibration data provided by the computing environment 105 for calibrating, adjusting, and/or operating the label applicators 103. In other examples, the controller 111 can determine the calibration data locally. Among other commands, the controller 111 can command the actuator 126 to activate at a particular time in order for the tamp head 123 to apply the label to the package 120*a* with a suitable level of accuracy and/or precision. The activation of the tamp head 123 triggers the actuator 126 to start lowering the tamp head 123 toward the conveyor belt 118.

The photoelectric sensor 115 can be a sensor that detects a height of a package 120 on the conveyor belt 118. Particularly, the photoelectric sensor 115 emits one or more light beams from a light emitting element. As a package 120 crosses in front of the light beam paths, one or more light beams can be used to determine that height of the package 120. For instance, one or more light beams that are interrupted by the package 120 can be used to measure the height of the package 120. In other scenarios, light beams that are reflected back from a reflective element can be used to determine the height. Other sensors can be used to determine the height of a package 120 on the conveyor system 117.

One or more cameras 113 can be used to provide images or video of the packages 120 on the conveyor belt 118. The cameras 113 can also be used to determine the dimensions of the packages 120, determine the locations of the packages 120 on the conveyor belt 118, and for evaluating the placement of labels after being applied on the packages 120. For example, a first camera 113 can be situated to identify the location of the package 120*a* as the package 120*a* moves toward the first label applicator 103*a*. Instead of a photoelectric sensor 115, the first camera 113 can also be used to assess the dimensions of the package 120*a* as it moves along the conveyor belt 118.

The second camera 113 can be situated at a location to capture images or video of the package 120*a* after the label has been applied. Then, the second camera 113 can be used to capture the location of the label applied to the package 120*a*.

As one example, the conveyor system 117 includes the conveyor belt 118 for moving the packages 120 from one area to another area. While the packages 120 are moving, the label applicator 103*a* can apply a label on the package 120*a*, as the package 120*a* passes below the label applicator 103*a*. The calibration data provided by the computing environment 105 can be relied upon by the controller 111 to calculate a proper time for triggering the actuator 126 of the label applicator 103*a* in order for the tamp head 126 to reach the package 120*a* at the appropriate time. By calculating the proper time using the calibration data, the label applicator 103*a* can place labels on the packages 120 with better accuracy and precision. The label applicators 103 can also measure a period of time that it takes to apply labels on the packages 120. The measured time period can be recorded and used to further estimate or update the calibration data and, thus, the timing of the tamp head 123.

Further, the cameras 113 can be used to assess the placement of the labels in order to generate feedback data. The feedback data can be generated based on a review of the actual placement of labels in comparison to a target position. The feedback data can be used for calibrating subsequent use of the tamp head 123 when applying labels. As a result, the label applicators 103 can achieve greater throughput with respect to the number of labels applied on packages 120 and can achieve improved label placements on the packages 120, particularly in scenarios of applying labels on moving packages 120.

Figure 2:
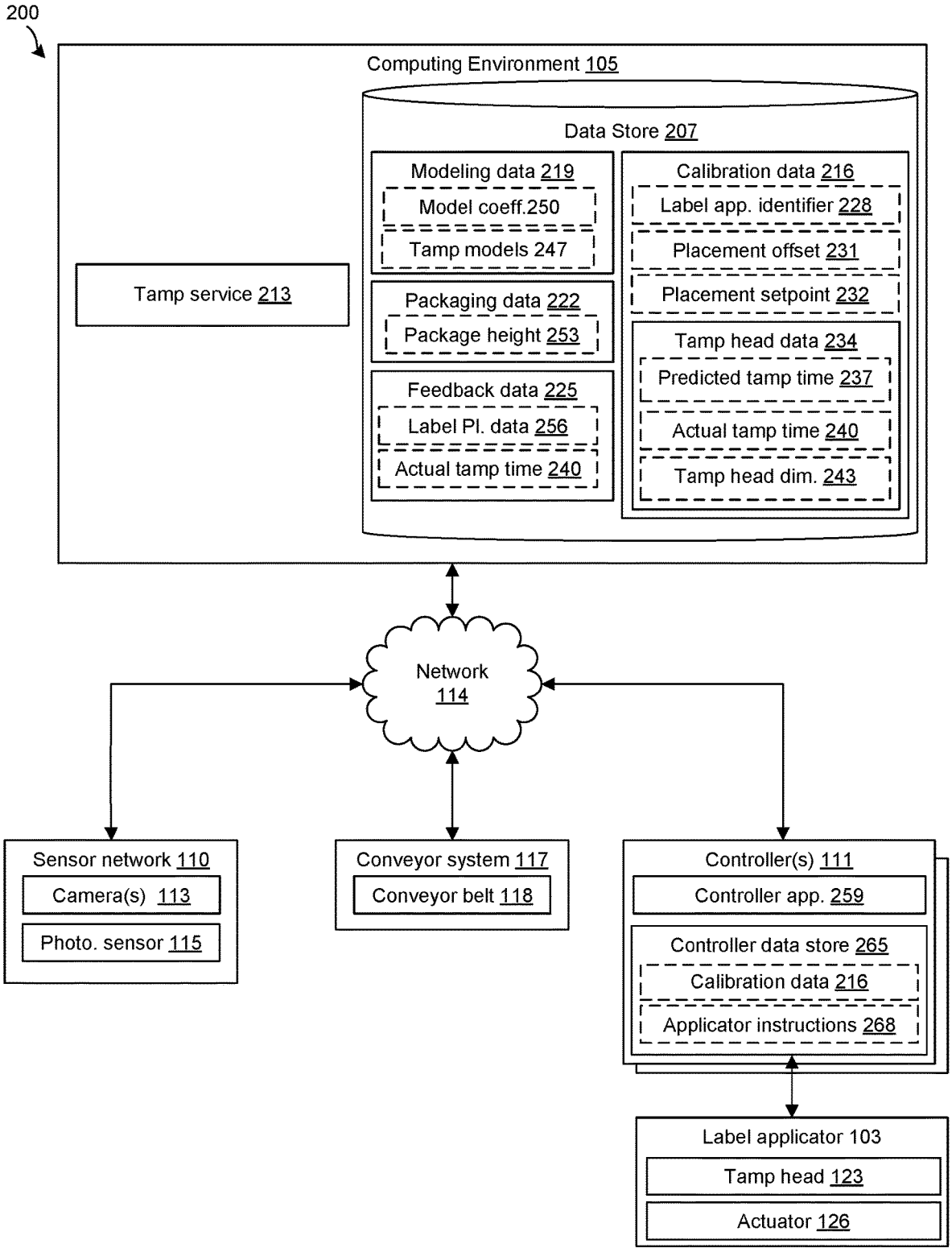
FIG. 2 is a drawing of a networked environment according to various embodiments of the present disclosure.

With reference to FIG. 2, shown is a networked environment 200 according to various embodiments. The networked environment 200 includes the computing environment 105, a sensor network 110, and the controller 111, which are in data communication with each other via the network 114. The network 114 includes, for example, the Internet, intranets, extranets, wide area networks (WANs), local area networks (LANs), wired networks, wireless networks, or other suitable networks, etc., or any combination of two or more such networks. For example, such networks may comprise satellite networks, cable networks, Ethernet networks, and other types of networks.

The computing environment 105 may comprise, for example, a server computer or any other system providing computing capability. Alternatively, the computing environment 105 may employ a plurality of computing devices that may be arranged, for example, in one or more server banks or computer banks or other arrangements. Such computing devices may be located in a single installation or may be distributed among many different geographical locations. For example, the computing environment 105 may include a plurality of computing devices that together may comprise a hosted computing resource, a grid computing resource and/or any other distributed computing arrangement. In some cases, the computing environment 105 may correspond to an elastic computing resource where the allotted capacity of processing, network, storage, or other computing-related resources may vary over time.

Various applications and/or other functionality can be executed in the computing environment 105 according to the embodiments. Also, data can be stored in a data store 207 that is accessible to the computing environment 105. The data store 207 can be representative of a plurality of data stores 207 as can be appreciated. The data stored in the data store 207, for example, is associated with the operation of the various applications and/or functional entities described below.

The components executed on the computing environment 105, for example, include a tamp service 213, and other applications, services, processes, systems, engines, or functionality not discussed in detail herein. The tamp service 213 can be executed to calibrate the tamp head 123 and other label applicator components in order to place labels with precision and/or accuracy on packages 120. The tamp service 213 can also be is executed to manage the operation of the label applicator 103, the conveyor system 117, or both the label applicator 103 and the conveyor system 117. In the context of the present disclosure, precision can refer to a closeness or repeatability of two or more actual label placements with respect to each other, and accuracy can refer to a closeness of an actual label placement to a targeted label placement location.

Among other data, the data stored in the data store 207 includes, for example, calibration data 216, modeling data 219, packaging data 222, feedback data 225, and potentially other data. Calibration data 216 can include data related to calibrating the label applicator 103. Calibration data 216 can include label applicator identifier 228, placement offset 231, and placement setpoint 232 data. Calibration data 216 can also include tamp head data 234. Label applicator identifier 228 includes a unique identifier for a particular label applicator 103, such as the label applicator 103*a* or 103*b* in FIG. 1. In some embodiments, the networked environment 200 may have more than one label applicator 103, in which case each label applicator 103 can have a different set of calibration data 216 for optimizing label placement for a number of different types of packages 120.

The placement setpoint 232 can refer to a distance from the label applicator 103 to a trigger position ahead of the label applicator 103 along the conveyor belt 118. The label applicator 103 can activate the tamp head 123 when the package 120 reaches the trigger position, in order to apply a label on a moving package 120 at a desired position with suitable accuracy. The placement setpoint 232 can be determined from the predicted tamp time 237.

The placement offset 231 can represent an adjustment factor for the placement setpoint 232. The placement offset 231 can be useful in scenarios in which the tamp head 123 is repeatedly placing labels on packages within a threshold variance, but the label placements still exceed an accuracy threshold with respect to a targeted label placement location. In some examples, the placement offset 231 may be determined based on a history of label placement performance. The placement offset 231 can be determined based on a comparison between an actual label placement position on a package 120 and a targeted placement of the label on the package 120.

Tamp head data 234 can include data related to the tamp head 123 used to apply a label on a package 120. The tamp head data 234 can include predicted tamp time 237, actual tamp time 240, and tamp head dimension 243. The predicted tamp time 237 can represent an estimated period of time that it takes for the actuator 126 to move the tamp head 123 from its initial position to a position in which the label can be applied (e.g., an apply position). The predicted tamp time 237 can be useful for timing the initiation of the actuator 126 for the tamp head 123 to arrive at an apply position at the appropriate time as the package 120 is moving on the conveyor belt 118. The predicted tamp time 123 can be generated based on several factors, such as modeling data 219, the tamp head dimensions 243, and an actual tamp time 240.

The actual tamp time 240 can be determined by measuring a period of time taken for the tamp head 123 to travel from its initial position to an apply position, which can be the desired position for applying the label on a package 120. In some embodiments, the apply position can be when the actuator 126 has reached a desired extension downward for applying the label on the package 120. The distance the tamp head 123 travels can be based on the tamp head dimensions 243 and the package height 253.

The tamp head dimension 243 can include data on the height, weight, length, width, and other dimensions of the tamp head 123. In some embodiments, the tamp head height can be a factor used to determine the predicted tamp time 237. For example, among other factors, the distance the tamp head 123 has to travel to apply the label to the package 120 can be based on the height of the package 120 and the height of the tamp head 123. The modeling data 219 can be used to determine the predicted tamp time 237. The modeling data 219 can include tamp models 247 and model coefficients 250 of the tamp model 247.

A tamp model 247 can represent one or more models used to determine calibration data 216 for individual label applicators 103. The tamp models 247 can be based on model coefficients 250 that are calculated and used in the tamp model 247. As a non-limiting example, one tamp model 247 can be used for determining the predicted tamp time 237. An exemplary tamp model 247 for determining the predicted tamp time 237 can be expressed by Equation 1 as follows:

$$t=a*h^b, \text{ where} \tag{1}$$

t represents the calculated predicted tamp time 237, h represents a tamp height minus a package height, and a and b represent model coefficients 250 that can be determined for each label applicator 103. The model coefficients 250 can be updated after the actual tamp time 240 has been measured and compared with the predicted tamp time 237. In one example, the model coefficients 250 were calculated using regression analysis based on sample data points of actual tamp times 240 that have occurred on a particular label applicator 103.

The data store 207 can also include data related to the packaging data 222. The packaging data 222 can include data related to the dimensions of one or more packages 120 on the conveyor belt 118. The packaging data 222 may include the weight, height, length, width, and other suitable dimensions of one or more packages 120. The packaging data 222 can be used to determine the predicted tamp time 237. For example, the package height 253 can factor into the determination of the predicted tamp time 237 for every package 120 being transported on the conveyor system 118. The package height 253 can be used to determine a distance the tamp head 123 has to travel from its initial position to a second position in which the label can be applied. In some embodiments, the packaging data 222 may be received from the sensor network 110.

Feedback data 225 can include data collected and analyzed after label placements, in order to provide feedback to the modeling data 219. The feedback data 225 can be used to update the modeling data 219 in order to achieve greater accuracy and/or precision on packages of a variety of different package heights 253 and/or to adapt to changing conditions. Feedback data 225 can include label placement data 256, and the actual tamp time 240. Label placement data 256 can represent location coordinates of a label placed on packages 120. The label coordinates can be used to compare the actual label placement with the targeted label placement. In some embodiments, the tamp service 213 can calculate error data based on the feedback data 225. Error data can include label placement error data, such as the difference between the actual label placement coordinates and the targeted label placement coordinates for a sample set. The error data can also include tamp time error, such as the difference between the actual tamp time 240 and the predicted tamp time 237 for a sample set. The label placement error and/or the tamp time error can be compared to an error threshold. These factors can be used to update the tamp models 247 and/or the placement offset 231.

The sensor network 110 can include one or more sensors for providing data on the packages 120 on the conveyor system 117. The sensor network 110 can include cameras 113 and photoelectric sensors 115. One or more cameras 208 can be situated for taking images or video of the packages 120 on the conveyor belt 118. For example, the images from the camera 113 can be used to identify the location of a particular package 120 on the conveyor belt 118 over time. The cameras 113 can also be used to determine the placement location of a label on a package after it has been applied.

The photoelectric sensor 115 can be used to determine physical characteristics of a package 120 on the conveyor belt 118, such as the height, length, width, and other physical characteristics. Other sensors can be included in the sensor network 110 and can be positioned at different locations on or around the conveyor system 117.

The controller 111 is representative of a plurality of controller devices that may be coupled to the network 114. The controller 111 may comprise, for example, a processor-based system, such as a programmable logic controller or related computer system. In various examples, such a computer system may be embodied in the form of a desktop computer, a laptop computer, personal digital assistants, a programming logic controller, or other devices with like capability.

The controller 111 is in data communication with the label applicator 103 in order to control the operations of components of the label applicator 103. The controller 111 may be configured to execute various applications, such as a controller application 259, and/or other applications. The controller application 259 can operate to direct the components of one or more label applicators 103. For example, the controller application 259 can activate the actuator 126 to move the tamp head 123. The controller application 259 can be in data communication and interface with the tamp service 213. The tamp service 213 can be embodied as instructions for operating the label applicators 103.

Also, various data is stored in a controller data store 265 that is accessible to the controller 111. The controller data store 265 may be representative of a plurality of controller data stores 265 as can be appreciated. The controller data store 265 may include the calibration data 216 and applicator instructions 268. The applicator instructions 268 include one or more commands for operating a label applicator 103.

Next, a general description of the operation of the various components of the networked environment 200 is provided. To begin, it is assumed one that one or more packages 120 are placed on a conveyor system 117. In this example, it is also assumed that labels are applied to the packages 120 while the packages 120 are moving below on the conveyor belt 118.

As a package 120 moves along the conveyor belt 118, one or more cameras 113 can identify a package height 253 of the package 120. The package height 253 is identified prior to the package reaching the label applicator 103. In some embodiments, the cameras 113 can use machine vision algorithms for identifying the package 120 in an image and for calculating the package height 253 of the package 120. In other embodiments, the cameras 113 can send the images of the package 120 to the controller 111 and/or the computing environment 105 for calculating the package height 253.

With the package height 253, the tamp service 213 can calculate calibration data 216 that is unique to the package 120. The calibration data 216 can be used to calibrate the tamp head 123 in order to apply a label on a targeted location of a package 120. In some examples, the calibration data 216 can include a predicted tamp time 237 and a placement offset 231. The predicted tamp time 237 can be calculated based on the package height 253 of the package 120. Thus, the predicted tamp time 237 can vary for each package 120 placed on the conveyor belt 118. The tamp service 213 can calculate the predicted tamp time 237 with a tamp model 247 that is unique to the label applicator 103 and the tamp head 123 of the label applicator 103. Accordingly, the predicted tamp time 237 can be calculated based on the tamp model 247 and the package height 253.

Next, the tamp service 213 can determine a placement setpoint 232 and a placement offset 231. The placement setpoint 232 can be determined from the predicted tamp time 237 and the speed of the conveyor belt 118. The placement setpoint 232 can be a position along the conveyor belt 118 for activating the tamp head 123. Since the placement setpoint 232 is located a certain distance ahead of the label applicator 103, the tamp head 123 can be provided sufficient time for reaching the package 120 while it is moving along the conveyor belt 118. The placement offset 231 can be used to adjust the placement setpoint 232 based on label placement data 256 received from previous placements.

The tamp service 213 can send the calibration data 216 to the controller 111. The controller 111 can use the predicted tamp time 237 and the placement setpoint 232 in order to determine a point along the conveyor belt 118 for activating the tamp head 123. Upon the package 120 reaching the placement setpoint 232, the controller 111 can activate the tamp head 123. The activation of the tamp head 123 causes the label applicator 103 to extend the actuator 126 toward the package 120. When the tamp head 123 reaches an apply position, the tamp head 123 applies the label on the package 120. The controller 111 can determine that the label has been applied to package 120 from image data provided by the cameras 113 or other suitable sensor data provided from the sensor network 110.

Subsequently, the controller 111 can store feedback data 225 during the application of the label and after the label has been applied. For example, the controller 111 can measure the actual tamp time 240 taken for the tamp head 123 to travel from its initial position to an apply position for applying the label. A first feedback mechanism for optimizing the predicted tamp time 237 can use the actual tamp time 240 for updating the tamp model 247. In some examples, the first feedback mechanism can be used to improve the precision of labels applied on multiple packages. Thus, the controller 111 can autonomously calibrate the precision of the label applicator 103 without operator intervention.

Additionally, a second feedback mechanism can be configured to improve the placement offset 231. For example, the cameras 113 can be used to identify an actual location of the placement of the label. The actual label placement can be compared to a targeted label location. The difference in distance between the actual label placement and the targeted label location can be stored as label placement data 256 and factored into subsequent placement offset determinations. The second feedback mechanism can be configured to improve the accuracy of the labels applied on multiple packages without operator intervention.

In another example, the first feedback mechanism for the tamp model 247 and the predicted tamp time 237 can affect the second feedback mechanism for the placement offset 231. For instance, the controller application 259 and/or the tamp service 213 can collect feedback data 225 from multiple label placements until a sample size threshold has been meet. Then, the performance of the tamp model 247 can be evaluated using the actual tamp times 240 and the predicted tamp time 237. Further, the performance of the label placement data 256 can be evaluated using the actual label placement locations and the targeted label placement locations.

In this example, if the tamp model 247 does not perform satisfactorily, then the tamp model 247 can be updated based on the feedback data 225. In some cases, the tamp model 247 can be evaluated based on a tamp time error for the sample set exceeding a tamp model threshold. The tamp time error can be the difference between the actual tamp time 240 and the predicted tamp time 237. If the tamp time error exceeds the tamp model threshold, then the tamp model 247 and/or the model coefficients 250 can be recalculated based at least on the sample set data. In this scenario, the placement offset 231 may not be updated because the tamp model 247 can affect the label placement data 256. Particularly, the tamp time error can be directly proportional to a label placement error associated with the placement offset 231.

Next, if the tamp model 247 did perform satisfactorily, then the tamp model 247 may not be updated. Then, the label placement data 256, particularly the label placement error, can be evaluated. If the label placement error exceeds a placement threshold, then the placement offset 231 can be calculated. In one example, the placement offset 231 can be determined based on a median of the label placement error collected from the sample data. Further, if the tamp model 247 performed satisfactorily with respect to the tamp model threshold and the label placement error is within placement threshold, then no action may be taken.

Figure 3:
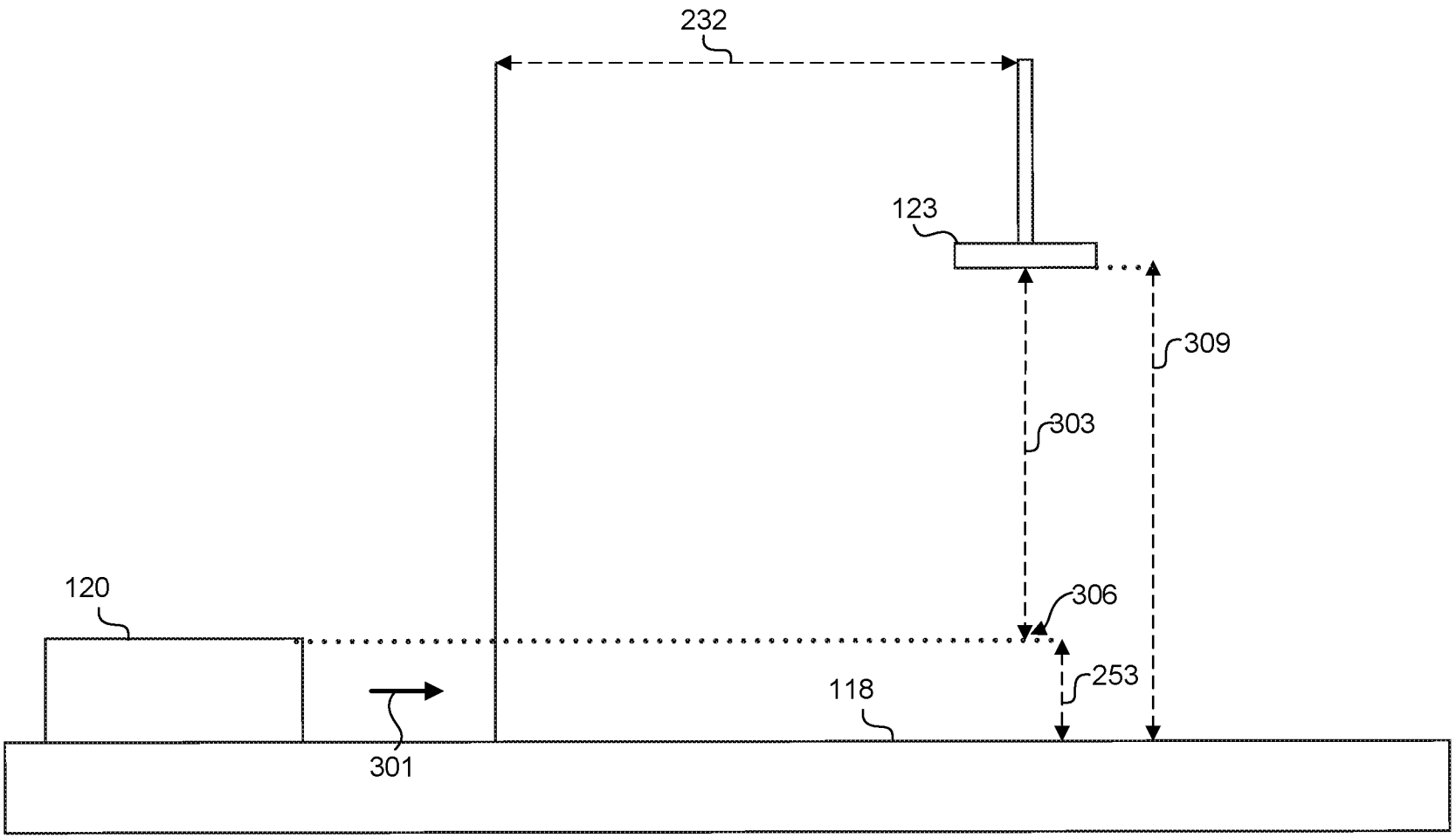
FIG. 3 is a pictorial diagram of a tamp head applying a label on a moving package on a conveyor belt according to various embodiments of the present disclosure.

FIG. 3 is a representative, pictorial diagram of the tamp head 123 applying a label on the package 120 on the conveyor belt 118. The direction of the moving package 120 is indicated by directional arrow 301, in which the package 120 is moving toward the tamp head 123 of the label applicator 103. The package height 253 is indicated in FIG. 3. The package height 253 can be determined from a photoelectric sensor 115. In other examples, the package height 253 can be determined from an image or video of the package 120 on the conveyor belt 118. The reference line 303 refers to the travel distance for the tamp head 123 to traverse between an initial position with the label applicator 103 and an apply position 306. The apply position 306 refers to a position in which the label is applied to the package 120 and the tamp head 123 begins to move back to its initial position. The apply position 306 can vary according to the package height 253 of the package 120. Thus, each apply position 306 can vary for each package 120 based on its package height 253.

An example placement setpoint 232 is also referenced in FIG. 3. The placement setpoint 232 can refer to a position along the conveyor belt 118 for triggering the tamp head 123 to move toward the package 120 and apply the label. In this example, the label can be applied on the fly. In context of the present disclosure, "apply on the fly" can refer to a label being applied onto a package 120 in a scenario in which the conveyor belt 118 does not stop or decrease in speed. Accordingly, the tamp head 123 can be activated at the placement setpoint 232. By activating the tamp head 123 at the placement setpoint 232, the tamp head 123 can travel the tamp distance 303 with sufficient time to apply the label at a target location on the package 120.

The placement setpoint 232 can be determined from several factors, such as the speed of the conveyor belt, a predicted tamp time 237 for traversing the tamp distance 303, and a placement offset 231. In some embodiments, the tamp distance 303 can be determined from the tamp height 309 minus the package height 253.

Figure 4:
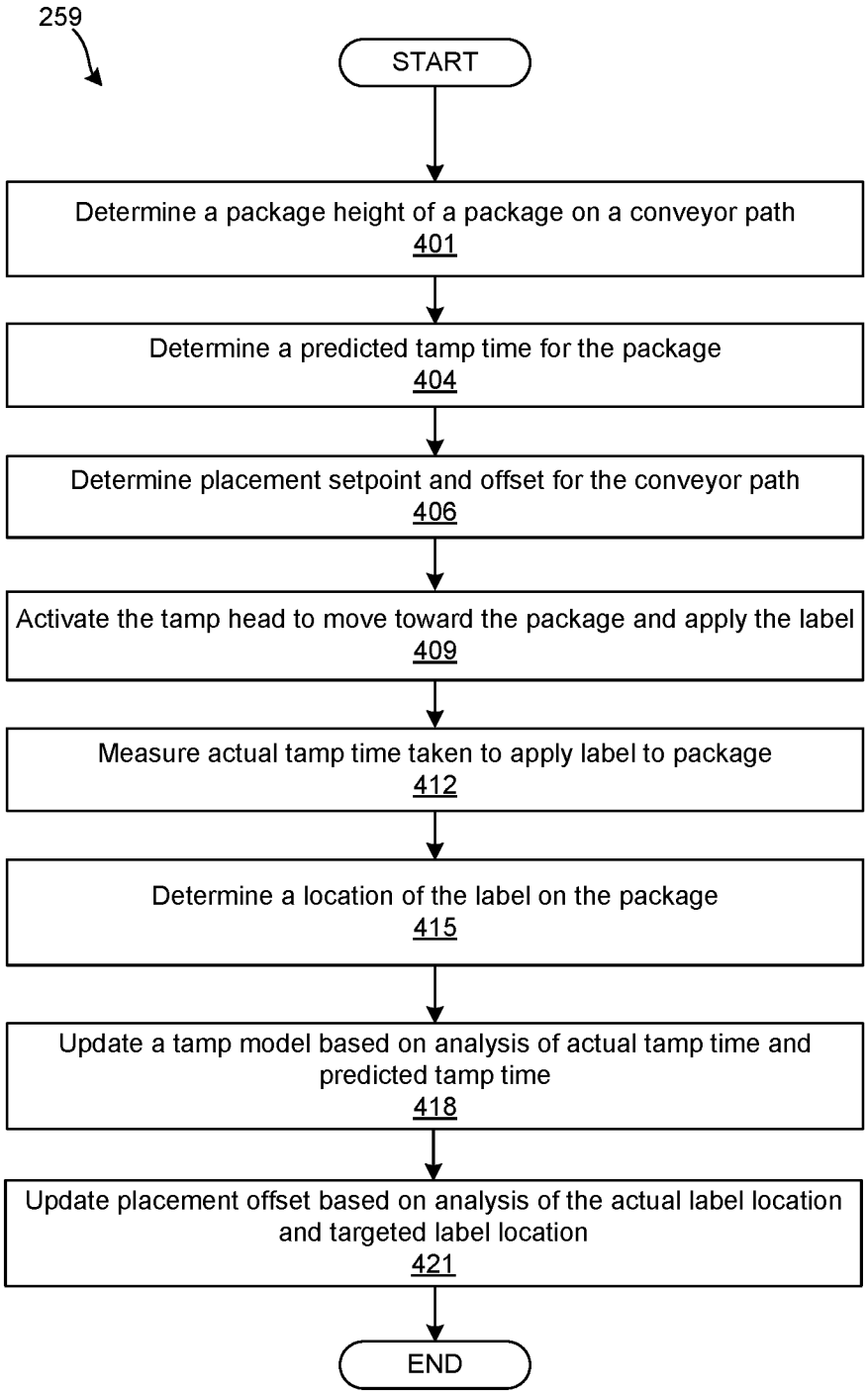
FIG. 4 is a flowchart illustrating an example process implemented by a controller in the networked environment of FIG. 2 according to various embodiments of the present disclosure.

Referring next to FIG. 4, shown is a flowchart that provides one example of the operation of a portion of the controller application 259 according to various embodiments. It is understood that the flowchart of FIG. 4 provides merely an example of the many different types of functional arrangements that may be employed to implement the operation of the portion of the controller application 259 as described herein. As an alternative, the flowchart of FIG. 4 may be viewed as depicting an example of elements of a method implemented in the controller 111 (FIG. 2) according to one or more embodiments. Additionally, the flowchart of FIG. 4 can be viewed as depicting an example of elements of a method implemented by a combination of the controller 111 and the computing environment 105.

Beginning with box 401, the example flowchart assumes that one or more packages 120 are placed on a conveyor system 117. The flowchart provides an exemplary progression for applying labels on packages 120 steadily moving along a conveyor belt 118. Further, the exemplary flowchart can be employed in a scenario in which the speed of the conveyor belt 118 dynamically changes. Further, one or more label applicators 103 can be suspended above a conveyor belt 118 of the conveyor system 117. The arrangement of the conveyor system 117 and label applicators 103 can vary.

Initially, as one example, the controller applicator 259 can determine a package height 253 of the package 120 on the conveyor belt 118. The package height 253 can be determined prior to the package 120 passing below the label applicator 103. In one embodiment, cameras 113 can be used to determine the package height 253. Images and/or video provided by the cameras 113 can be analyzed using machine vision algorithms to generate a package height 253 for each package 120 transported on the conveyor belt 118. In another embodiment, the packaging data 222 can be retrieved after identifying a package identifier on the package 120. The retrieved packaging data 222 may include the dimensions of the package 120. Images and/or video provided by the camera 113 can also be used to determine an orientation of the package 120 on the conveyor belt 118. Accordingly, the controller application 259 can determine which side of the package 120 is on the conveyor belt 118. From knowing the side in contact with the conveyor belt 118, the controller application 259 can determine a distance from the side in contact with the conveyor belt 118 to the opposing side of the package 120 which is facing upward based on the package dimensions. Thus, in some embodiments, the controller application 259 determines the package height 253 of every package 120 before the package 120 reaches the label applicator 103.

In box 404, the controller application 259 can determine a predicted tamp time 237 for the package 120, before the package 120 reaches the label applicator 103. The predicted tamp time 237 can be unique to each package 120 and each label applicator 103. The predicted tamp time 237 can be based on a tamp model 247. The tamp model 247 can provide the predicted tamp time 237 based on one or more factors, such as the tamp head height TH, the package height 253, and/or other suitable factors. The tamp model 247 can also consider the factors associated with the conveyor system 117, such as the speed that the conveyor belt 118 is moving the package 120.

In some embodiments, the tamp model 247 can include one or more model coefficients 250 in an equation for providing the predicted tamp time 237 (e.g. Equation 1). The model coefficients 250 can be determined from a regression analysis of previous actual tamp times 240.

In box 406, the controller application 259 can determine a placement setpoint 232 and a placement offset 231 for a particular label applicator 103. The placement setpoint 232 can refer to a position along a conveyor path prior to the label applicator 103 in which the tamp head 123 will be triggered in order to apply the label on the package 120 at the targeted location. Thus, the placement setpoint 232 can be a distance prior to the label applicator 103 along the conveyor belt 118.

In box 409, the controller application 259 can activate the tamp head 123 to lower toward the package 120 and apply the label based on the predicted tamp time 237 and/or the placement offset 231. For example, if the predicted tamp time 237 is one second and the conveyor belt 118 is moving at rate of one foot per second, then the placement setpoint can be one foot in front of the label applicator 103. Thus, the label applicator 103 can activate the tamp head 103 when the package 120 reaches the placement setpoint 232 of one foot in front of the label applicator 103. In this example, the placement offset 231 can be set to one inch. As a result, the placement setpoint 232 can be set to one foot and one inch preceding the label applicator 103.

In box 412, the controller application 259 can measure the actual tamp time 240 taken to apply the label on the package 120. For example, a timer associated with the controller 111 can be initiated to track a period of time from the activation of an actuator 126 to when the tamp head 123 reaches an apply position in which the label is applied. In some examples, the timer may measure a period of time from the activation of a solenoid that extends the tamp head 123 to the apply position. In some instances, the controller application 259 can evaluate whether the difference between each measured actual tamp time 240 and the predicted tamp time 237 is within a tolerance threshold. The controller application 259 can store the difference between the actual tamp time 240 and the predicted tamp time 237 for each package as the feedback data 225. When one or more actual tamp times 240 are not within the tolerance threshold, the tamp service 213 and/or the controller application 259 may recalculate the tamp model 247 and/or the model coefficients 250.

In box 415, the controller application 259 can determine the location of the label placed on the package 120. The location of the label placement can be used for evaluating how close the label was placed in comparison to a targeted location. The placement location of a label can be determined from an image or video provided by a camera 113 and the label placement can be stored as label placement data 256. In some embodiments, the camera 113 can provide location coordinates to indicate the location on the label. The location coordinates can be in respect to one or more edges of the package 120.

In box 418, the controller application 259 can update the tamp model 247 based on an analysis of the actual tamp time 240 and the predicted tamp time 237. In some embodiments, the actual tamp time 240 and the predicted tamp time 237 can be compared and used to update the tamp model 247, which is associated with a particular label applicator 103. In some examples, updating the tamp model 247 can involve updating one or more model coefficients 250 used in the tamp model 247. The model coefficients 250 calculated and/or updated based on previous actual tamp times 240. Thus, updating the model coefficients 250 based on one or more recent actual tamp times 240 provides a closed-loop feedback mechanism for adjusting the predicted tamp time 237. As such, the predicted tamp time 237 can be uniquely calculated for a label applicator 103 and the package height 253 of a package 120. For example, if the predicted tamp time 237 is 1 second and the actual tamp time 240 is measured as 1.25 seconds, then the difference between the two times can be factored into a regression analysis for updating the model coefficients 250. In some embodiments, the tamp model 247 and/or the modeling coefficients 250 can be recalculated when the difference between the actual tamp time 240 and the predicted tamp time 237 exceeds a threshold. In some embodiments, the tamp model 247 and/or the modeling coefficients 250 are calculated after a number of actual tamp times 240 measured meet a sample size threshold.

In box 421, the controller application 259 can update the placement offset 231 based on an analysis of the actual label location and the targeted label location. For example, the actual label location is compared to the targeted label location. The difference in distance between the two locations can be used to update the placement offset 231 for a particular label applicator 103. In some embodiments, the placement offset 231 can be determined based on a regression analysis of one or more factors, such as the predicted tamp time 237, the package height 253, the speed of the conveyor belt 118, and other suitable factors associated with the conveyor system 117 or the label applicator 103. In some embodiments, the placement offset 231 can be recalculated when the difference between the actual label placement and the targeted label location exceeds a threshold. Then, the controller application 259 can proceed to the end.

Figure 5:
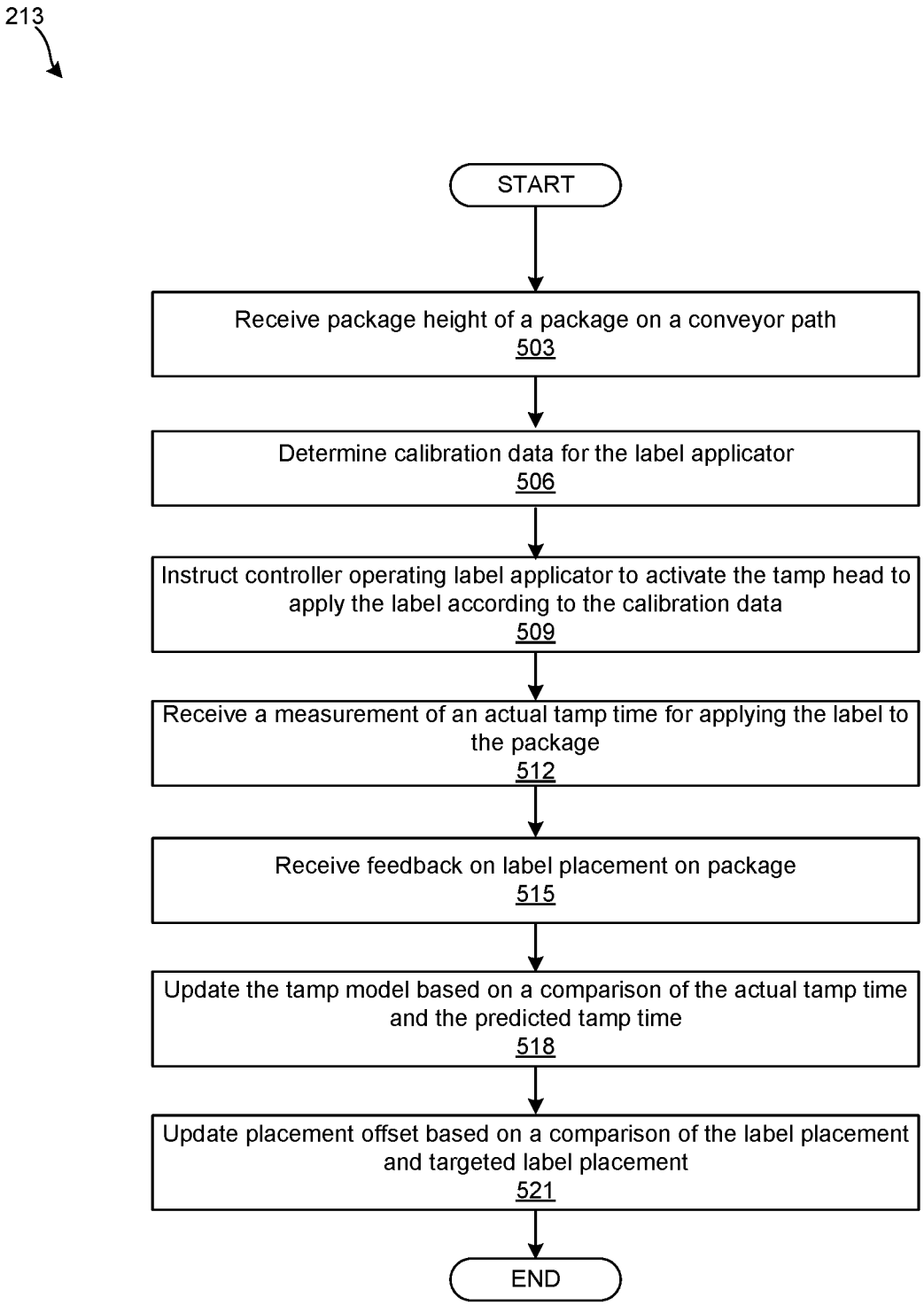
FIG. 5 is a flowchart illustrating an example process implemented by a tamp service application in the networked environment of FIG. 2 according to various embodiments of the present disclosure.

Referring next to FIG. 5, shown is a flowchart that provides one example of the operation of a portion of the tamp service 213 according to various embodiments. It is understood that the flowchart of FIG. 5 provides merely an example of the many different types of functional arrangements that may be employed to implement the operation of the portion of the tamp service 213 as described herein. As an alternative, the flowchart of FIG. 5 may be viewed as depicting an example of elements of a method implemented in the computing environment 105 (FIG. 2) according to one or more embodiments. Additionally, the flowchart of FIG. 5 can be viewed as depicting an example of elements of a method implemented by a combination of the controller 111 and the tamp service 213 of the computing environment 105.

Beginning with box 503, the example flowchart assumes that one or more packages 120 are placed on a conveyor system 117. The flowchart provides an exemplary progression for applying labels on packages 120 steadily moving along a conveyor belt 118. Further, one or more label applicators 103 can be suspended above a conveyor belt 118 of the conveyor system 117. The arrangement of the conveyor system 117 and label applicators 103 can vary.

Initially, in one example, the tamp service 213 can receive a package height 253 of a package 120 on conveyor belt 118. In some embodiments, the tamp service 213 can receive a label applicator identifier 228 that is associated with particular label applicator 103. In some embodiments, the package height 253 can be received from a camera 113. The camera 113 can process a stored image of the package 120 in order to generate a package height 253. The camera 113 can use a machine vision algorithm for calculating the package height 253. In other examples, the camera 113 transmits the image or video to the tamp service 213 and the tamp service 213 can process the media for calculating the package height 253 of each package 120.

In box 506, the tamp service 213 can determine calibration data 216 for the label applicator 103. The calibration data 216 can include a predicted tamp time 237 and a placement setpoint 232. The predicted tamp time 237 can be calculated based on the tamp model 247 and a package height 253. In some examples, the tamp service 213 can retrieve the tamp model 247 based on a label applicator identifier 228. The tamp model 247 can include model coefficients 250. The predicted tamp time 237 can be calculated as a function of the package height 253 for the tamp model 247.

The placement setpoint 232 can be calculated based on the predicted tamp time 237 and a speed of the conveyor belt 118. The placement setpoint 232 can also be determined based on a placement offset 231, and the placement offset 231, in some examples, can be calculated from historical label placement data 256. The historical label placement data 256 includes data on the difference between a targeted label placement and an actual label placement over multiple attempts.

Further, with respect to the calibration data 216, the tamp service 213 can calculate the placement offset 231. In some examples, the placement offset 231 may be determined based on a history of label placement performance. The placement offset 231 can be determined based on a comparison between an actual label placement position on a package 120 and a targeted placement of the label on the package 120. Further, in one embodiment, the placement offset 231 can be calculated when a placement error (e.g. a difference between the actual label placement position and the targeted placement location) meets an error threshold. In some cases, the placement error may be evaluated after a sample size of the label placement data 256 meets a sample threshold.

In box 509, the tamp service 213 can instruct the controller 111 to activate the tamp head 123 according to the calibration data 216. Accordingly, when the package 120 reaches the placement setpoint 232, the controller 111 will activate the tamp head 123 to be extended to an apply position and apply the label at the apply position.

In box 512, the tamp service 213 can receive a measurement of an actual tamp time 240 for applying the label to the package 120. The controller 111 can measure the actual tamp time 240 in the process of applying the label to the package 120. The controller 111 can then transmit the actual tamp time 240 and other suitable data to the computing environment 105.

In box 515, the tamp service 213 can receive feedback data 225 on the label placement on the package 120. The label placement can be used to determine a difference between the targeted label placement and an actual label placement.

In box 518, the tamp service 213 can update the tamp model 247 based on a comparison between the actual tamp time 240 and the predicted tamp time 237. In some embodiments, the difference between the actual tamp time 240 and the predicted tamp time 237 can be used to recalculate one or more model coefficients 250, which are used to calculate the predicated tamp time 237.

In box 521, the tamp service 213 can update the placement offset 231 based on a comparison between the targeted label placement and the actual label placement. In some embodiments, the placement offset 231 can be updated after receiving comparison data on a threshold number of attempts for placing labels on packages. Then, the tamp service 213 proceeds to the end.

Figure 6:
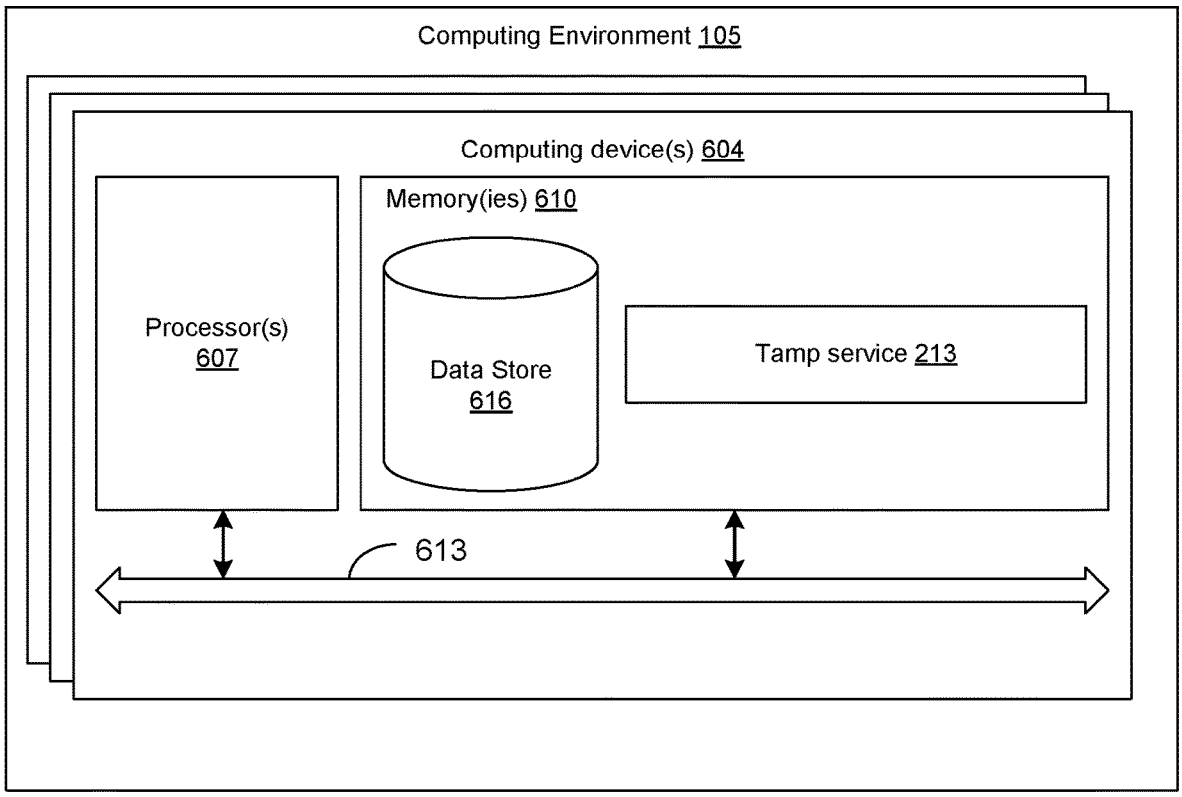
FIG. 6 is a schematic block diagram that provides one example illustration of a computing environment employed in the networked environment of FIG. 2 according to various embodiments of the present disclosure.

With reference to FIG. 6, shown is a schematic block diagram of the computing environment 105 according to an embodiment of the present disclosure. The computing environment 105 includes one or more computing devices 604. Each computing device 604 includes at least one processor circuit, for example, having a processor 607 and a memory 610, both of which are coupled to a local interface 613. To this end, each computing device 604 may comprise, for example, at least one server computer or like device. The local interface 613 may comprise, for example, a data bus with an accompanying address/control bus or other bus structure as can be appreciated.

Stored in the memory 610 are both data and several components that are executable by the processor 607. In particular, stored in the memory 610 and executable by the processor 607 are the tamp service 213 and potentially other applications. Also stored in the memory 610 may be a data store 616 and other data. In addition, an operating system may be stored in the memory 610 and executable by the processor 607.

It is understood that there may be other applications that are stored in the memory 610 and are executable by the processor 607 as can be appreciated. Where any component discussed herein is implemented in the form of software, any one of a number of programming languages may be employed such as, for example, C, C++, C#, Objective C, Java®, JavaScript®, Perl, PHP, Visual Basic®, Python®, Ruby, Flash®, or other programming languages.

A number of software components are stored in the memory 610 and are executable by the processor 607. In this respect, the term "executable" means a program file that is in a form that can ultimately be run by the processor 607. Examples of executable programs may be, for example, a compiled program that can be translated into machine code in a format that can be loaded into a random access portion of the memory 610 and run by the processor 607, source code that may be expressed in proper format such as object code that is capable of being loaded into a random access portion of the memory 610 and executed by the processor 607, or source code that may be interpreted by another executable program to generate instructions in a random access portion of the memory 610 to be executed by the processor 607, etc. An executable program may be stored in any portion or component of the memory 610 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 610 is defined herein as including both volatile and nonvolatile memory and data storage components. Volatile components are those that do not retain data values upon loss of power. Nonvolatile components are those that retain data upon a loss of power. Thus, the memory 610 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory devices.

Also, the processor 607 may represent multiple processors 607 and/or multiple processor cores and the memory 610 may represent multiple memories 610 that operate in parallel processing circuits, respectively. In such a case, the local interface 613 may be an appropriate network that facilitates communication between any two of the multiple processors 607, between any processor 607 and any of the memories 610, or between any two of the memories 610, etc. The local interface 613 may comprise additional systems designed to coordinate this communication, including, for example, performing load balancing. The processor 607 may be of electrical or of some other available construction.

Although the tamp service 213 and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowcharts of FIGS. 4 and 5 show the functionality and operation of an implementation of portions of the computing environment 105, the tamp service 213, the controller 111, and the controller application 259. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 607 in a computer system or other system. The machine code may be converted from the source code, etc. If embodied in hardware, each block may represent a circuit or a number of interconnected circuits to implement the specified logical function(s).

Although the flowcharts of FIGS. 4 and 5 show a specific order of execution, it is understood that the order of execution may differ from that which is depicted. For example, the order of execution of two or more blocks may be scrambled relative to the order shown. Also, two or more blocks shown in succession in FIGS. 4 and 5 may be executed concurrently or with partial concurrence. Further, in some embodiments, one or more of the blocks shown in FIGS. 4 and 5 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including tamp service 213 and the controller application 259, that comprises software or code can be embodied in any non-transitory computer-readable medium for use by or in connection with an instruction execution system such as, for example, a processor 607 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Further, any logic or application described herein, including the tamp service 213 and the controller application 259, may be implemented and structured in a variety of ways. For example, one or more applications described may be implemented as modules or components of a single application. Further, one or more applications described herein may be executed in shared or separate computing devices or a combination thereof. For example, a plurality of the applications described herein may execute in the same computing device 604, or in multiple computing devices in the same computing environment 105. Additionally, it is understood that terms such as "application," "service," "system," "engine," "module," and so on may be interchangeable and are not intended to be limiting.

Figure 7:
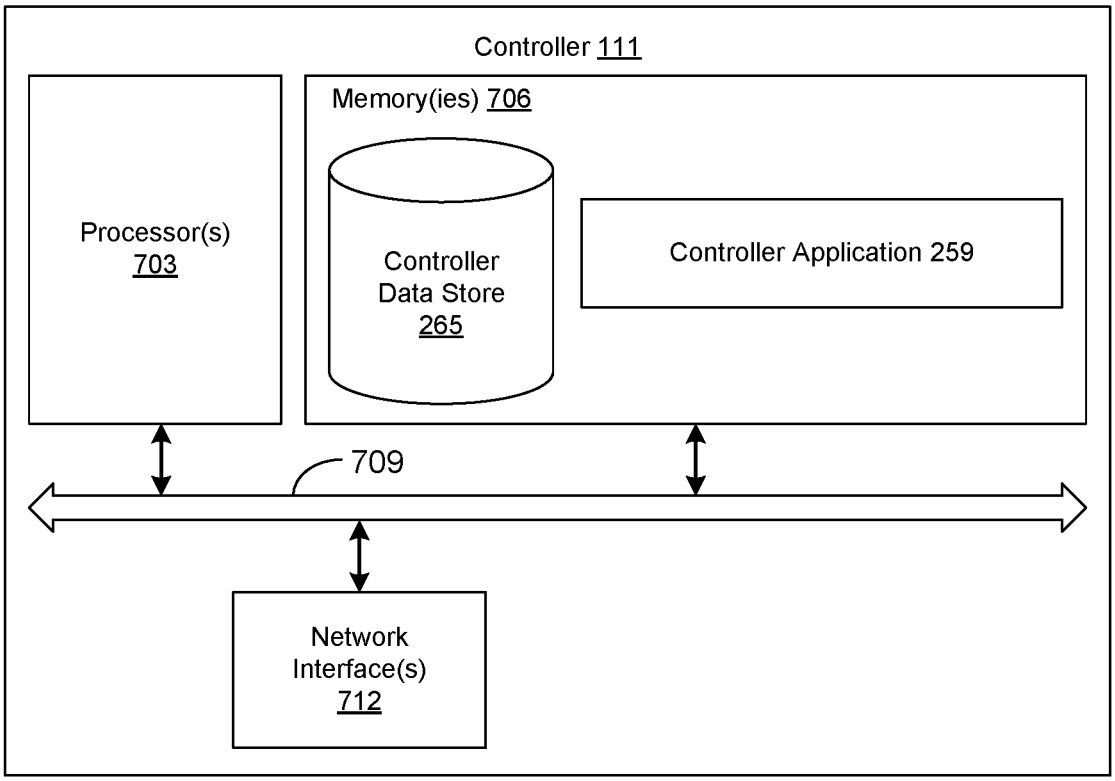
FIG. 7 is a schematic block diagram that provides one example illustration of a controller employed in the networked environment of FIG. 2 according to various embodiments of the present disclosure.

With reference to FIG. 7, shown is a schematic block diagram of the controller 111 according to an embodiment of the present disclosure. The controller 111 includes at least one processor circuit, for example, having a processor 703 and a memory 706, both of which are coupled to a local interface 709. The local interface 709 may comprise, for example, a data bus with an accompanying address/control bus or other bus structure as can be appreciated. The controller 111 can include a network interface 712 for communicating over the network 114. The controller 111 can also include digital input/output ports and analog input/output ports. These ports can be used to interface with the sensor network 110, and/or other components in the networked environment 200.

Stored in the memory 706 are both data and several components that are executable by the processor 703. In particular, stored in the memory 706 and executable by the processor 703 is controller application 259, and potentially other applications. Also stored in the memory 706 may be a controller data store 265 and other data. In addition, an operating system may be stored in the memory 706 and executable by the processor 703.

It is understood that there may be other applications that are stored in the memory 706 and are executable by the processor 703 as can be appreciated. Where any component discussed herein is implemented in the form of software, any one of a number of programming languages may be employed such as, for example, C, C++, C#, Objective C, Java®, JavaScript®, Perl, PHP, Visual Basic®, Python®, Ruby, Flash®, or other programming languages.

A number of software components are stored in the memory 706 and are executable by the processor 703. In this respect, the term "executable" means a program file that is in a form that can ultimately be run by the processor 703. Examples of executable programs may be, for example, a compiled program that can be translated into machine code in a format that can be loaded into a random access portion of the memory 706 and run by the processor 703, source code that may be expressed in proper format such as object code that is capable of being loaded into a random access portion of the memory 706 and executed by the processor 703, or source code that may be interpreted by another executable program to generate instructions in a random access portion of the memory 706 to be executed by the processor 703, etc. An executable program may be stored in any portion or component of the memory 706 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 706 is defined herein as including both volatile and nonvolatile memory and data storage components. Volatile components are those that do not retain data values upon loss of power. Nonvolatile components are those that retain data upon a loss of power. Thus, the memory 706 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 703 may represent multiple processors 703 and/or multiple processor cores and the memory 706 may represent multiple memories 706 that operate in parallel processing circuits, respectively. In such a case, the local interface 709 may be an appropriate network that facilitates communication between any two of the multiple processors 703, between any processor 703 and any of the memories 706, or between any two of the memories 706, etc. The local interface 709 may comprise additional systems designed to coordinate this communication, including, for example, performing load balancing. The processor 607 may be of electrical or of some other available construction.

Although controller application 259, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A non-transitory computer-readable medium embodying a program that when, executed by at least one computing device, causes the at least one computing device to at least:

determine a package height of a package on a conveyor path prior to the package reaching a tamp head of a label applicator;

determine a predicted tamp time for the package based at least in part on the package height and a modeling coefficient, the predicted tamp time being an estimated period of time for a tamp head to apply a label on the package from being initiated;

determine a placement setpoint along the conveyor path based on the predicted tamp time, the placement setpoint being a distance preceding the tamp head along the conveyor path;

activate the tamp head to apply the label on the package based at least in part on a detection of the package reaching the placement setpoint on the conveyor path;

determine an actual tamp time for the tamp head to apply the label on the package; and update the modeling coefficient based at least in part on a comparison of the actual tamp time and the predicted tamp time.

2. The non-transitory computer-readable medium of claim 1, wherein the placement setpoint is further determined based at least in part on a placement offset.

3. The non-transitory computer-readable medium of claim 2, wherein the program further causes the at least one computing device to at least:

detect a label placement of the label on the package based at least in part on an image of the package; and update the placement offset based at least in part on a comparison between the label placement and a target label position.

4. The non-transitory computer-readable medium of claim 1, wherein the actual tamp time is determined based at least in part on a first point in time of an activation of a solenoid for the tamp head and a second point in time in which the label is applied to the package.

5. A system, comprising:

a computing device; and a memory to store an application that, when executed by the computing device, causes the computing device to at least:

receive a package height of a package on a conveyor path prior to the package reaching a tamp head of a label applicator;

determine a predicted tamp time for the package based at least in part on the package height and a modeling coefficient, the predicted tamp time being an estimated period of time for the tamp head to apply a label on the package from being initiated;

instruct a controller operating a label applicator to activate the tamp head for the package based at least in part on the predicted tamp time;

receive an actual tamp time from the controller after the label has been applied to the package; and update the modeling coefficient based at least in part on a comparison of the actual tamp time and the predicted tamp time.

6. The system of claim 5, wherein the application, when executed, further causes the computing device to at least:

determine a placement setpoint along the conveyor path based on the predicted tamp time and a placement offset, the placement setpoint being a distance preceding the tamp head along the conveyor path in which the tamp head is triggered for applying the label.

7. The system of claim 6, wherein the placement setpoint is further determined based at least in part on a speed of a conveyor belt on the conveyor path.

8. The system of claim 6, wherein the application, when executed, further causes the computing device to at least:

receive, from the controller, a label placement of the label on the package; and update the placement offset based at least in part on a comparison between the label placement and a target label position.

9. The system of claim 8, wherein the comparison is based at least in part on an edge of the package in the label placement and a target edge associated with the target label position.

10. The system of claim 5, wherein the modeling coefficient is updated based at least in part on a difference between the predicted tamp time and the actual tamp time meeting a threshold.

11. The system of claim 5, wherein the predicted tamp time for the package is determined based at least in part on a difference between a tamp height and the package height.

12. The system of claim 5, wherein, to update the modeling coefficient, the application further causes the computing device to:

store in the memory the modeling coefficient in association with a label applicator identifier or a tamp head identifier.

13. The system of claim 5, wherein, to determine the predicted tamp time for the package, the application further causes the computing device to:

retrieve the modeling coefficient from memory based at least in part on a label applicator identifier.

14. The system of claim 5, wherein the application, when executed, further causes the computing device to at least:

determine the modeling coefficient based at least in part on a regression analysis of a history of actual tamp times for the label applicator.

15. A method, comprising:

receiving, by one or more computing devices, a package height of a package on a conveyor path prior to the package reaching a tamp head of a label applicator;

determining, by the one or more computing devices, a predicted tamp time for the package based at least in part on the package height and a tamp model, the predicted tamp time being an estimated period of time for the tamp head to apply a label on the package from being initiated;

causing, by the one or more computing devices, the tamp head to activate the tamp head for the package based at least in part on the predicted tamp time;

measuring, by the one or more computing devices, an actual tamp time for the tamp head to apply the label; and updating, by the one or more computing devices, the tamp model based at least in part on a comparison of the actual tamp time and the predicted tamp time.

16. The method of claim 15, further comprising:

determining, by the one or more computing devices, a placement setpoint along the conveyor path based on the predicted tamp time and a placement offset, the placement setpoint being a distance in front of the tamp head along the conveyor path.

17. The method of claim 16, wherein causing the tamp head to activate the tamp head for the package is further based at least in part on a detection of the package reaching the placement setpoint.

18. The method of claim 16, further comprising:

determining, by the one or more computing device, a label placement of the label on the package; and updating, by the one or more computing device, the placement offset based at least in part on a comparison between the label placement and a target label position.

19. The method of claim 16, wherein the placement setpoint is further based at least in part on a speed of a conveyor belt on the conveyor path.

20. The method of claim 15, wherein updating the tamp model further comprises:

updating, by the one or more computing device, a coefficient value in the tamp model based at least in part on the comparison of the actual tamp time and the predicted tamp time; and storing, by the one or more computing device, the coefficient value in association with an identifier associated with the label applicator.

* * * * *